US006255568B1

(12) United States Patent
Dunwoodie

(10) Patent No.: US 6,255,568 B1
(45) Date of Patent: Jul. 3, 2001

(54) SADDLE FOR AN ELECTRO-ACOUSTIC STRINGED INSTRUMENT

(76) Inventor: David Andrew Dunwoodie, #8 - 11760 Bird Road, Richmond, British Columbia (CA), V6X 1N9

( * ) Notice: Subject to any disclaimer, the term of this patent is extended or adjusted under 35 U.S.C. 154(b) by 0 days.

(21) Appl. No.: 09/389,713

(22) Filed: Sep. 3, 1999

(51) Int. Cl.[7] ..... G10D 3/04

(52) U.S. Cl. ..... 84/298; 84/299; 84/307; 84/731; 84/723; 84/730; 84/726

(58) Field of Search ..... 84/298, 299, 300, 84/301, 302, 307, 723, 730, 731, 726

(56) References Cited

U.S. PATENT DOCUMENTS 5,078,041 * 1/1992 Schmued ..... 84/731

5,644,094 7/1997 Dickson ..... 84/307

* cited by examiner

*Primary Examiner*—Shih-Yung Hsieh
(74) *Attorney, Agent, or Firm*—Kolisch Hartwell Dickinson McCormack & Heuser

(57) ABSTRACT

A saddle for an electro-acoustic stringed instrument is provided having a string supporting member supported by a plurality of pillars. The pillars have bases and are separated from each other by gaps which are relatively large in comparison to the bases. The saddle has a total base area, defined by the combined area of the bases, which is relatively small compared to the total base area of a saddle with a continuous base surface, such that a biasing force applied to the string supporting member is applied to a relatively smaller area. Furthermore, all of the bases have substantially equal surface areas such that force applied to the string supporting member is transmitted to each base equally. Each of the pillars has constant cross-sectional areas along its length so that adjusting the height of a pillar does not change the surface area of its base.

9 Claims, 2 Drawing Sheets

SADDLE FOR AN ELECTRO-ACOUSTIC STRINGED INSTRUMENT

FIELD OF THE INVENTION

This invention relates to saddles for stringed instruments and more particularly to a saddle for a stringed instrument which uses a piezo-electric acoustical pickup.

BACKGROUND

A conventional acoustical stringed instrument comprises a hollow body having a front face or sounding board, a back face which is substantially parallel to the sounding board, and a connecting portion which connects the sounding board to the back face around a perimeter of the respective faces. A longitudinally extending neck member extends from the body and has a distal end having a plurality of string receiving and tighting members. A bridge having a slot therein disposed perpendicularly to the neck member is connected to the sounding board, remote from the neck member. A plurality of strings extend between the bridge and the string receiving and tightening members such that the strings can be releasably placed under tension. A saddle comprising an elongated, narrow strip of hard material, such as ivory, bone or hard plastic, is slideably fitted into the slot in the bridge to support the strings. When the strings are tightened, string tension presses the strings against the saddle and presses the saddle against the bottom of the slot in the bridge. When the instrument is played, vibrational energy from the strings is transmitted through the saddle and the bridge into the sounding board and into the body of the instrument, where it resonates and produces sound.

With the advent of recorded and amplified music, it became necessary to devise a method of electrically capturing the sound from acoustical instruments. This could be accomplished by using microphones placed on or near the instrument, or more conveniently, by placing a "pickup" under the saddle to convert the string vibrations into an electrical signal. An instrument with such a pickup would be an "electro-acoustical" instrument.

A pickup comprises an array of individual piezo-electric crystals which are spaced apart such that each crystal corresponds to one of the strings. Each crystal has one side fixed to a flexible conducting substrate which is connected to a signal ground, and an opposite side connected to an electrical amplifier by a conducting wire. As is well known in the art, a piezo-electric crystal generates a voltage which is proportional to an applied mechanical force. A crystal generates a voltage having a first polarity in response to a compression force and a voltage. having a second, opposite polarity in response to a tension force. Vibrations transmitted from a first string to the saddle result in an applied force at a corresponding first crystal, thereby generating an electrical signal which is proportional to the string vibrations.

As in a conventional acoustic instrument, the saddle is held in the bridge by string tension. The saddle is thereby held in contact with the pickup by string tension, but is not connected to the pickup. Therefore, the saddle can exert a compression force on the pickup but cannot exert a tension force and therefore the pickup cannot generate signals of alternating polarity. However, the string vibrations do alternate between positive and negative maxima and the output from the pickup must be able to accurately follow the string vibrations. One solution has been to apply sufficient string tension to the saddle to cause the saddle to exert a substantially constant biasing force on the pickup which generates a DC biasing voltage in response thereto. When the instrument is played, string vibrations cause differential forces which add to or subtract from the biasing force, resulting in varying compression forces on the pickup and corresponding electrical signals which vary around the DC biasing voltage without changing polarity. The biasing force must be sufficiently large such that the differential forces will not reduce it to zero or the electrical signals will be forced to zero and clipping and distortion will occur.

Difficulties arise in properly loading the pickup such that each crystal has sufficient contact with the saddle and a sufficiently large biasing force applied to it. If the saddle does not contact an individual crystal, no signal will be generated for the corresponding string. If an individual crystal is loaded more or less heavily than the other crystals, the signal volume of the corresponding string will not be balanced with the other strings. These difficulties arise in part because the bridge, in which the saddle and pickup are positioned, is typically made of wood. Wood is heterogeneous, having soft spring wood and hard summer wood, for example. Crystals adjacent soft portions of the bridge may require more biasing force than crystals adjacent hard portions. Matters are further complicated by the fact that the sounding board, upon which the bridge, pickup and saddle rest, may be arched or "bellied-up". The amount of arch typically increases as the strings are tightened such that a saddle which fits correctly when the strings are slackened may not fit when the strings are tightened. The bridge and the piezo-electric pickup are made of relatively flexible materials and will bend to conform with this arched surface but the saddle is made of hard, rigid material and must be shaped to make it conform.

Conventionally, saddles for acoustic instruments have had a continuous lower surface which contacted the bottom of the slot in the bridge so as to efficiently transmit vibrations to the sounding board. However, when using this type of saddle with a pickup, it might be necessary to remove material from the entire length of the lower surface of the saddle to ensure uniform contact with the pick-up when the strings are tightened. Removing material from this relatively large area may result in a laborious shaping operation involving the removal of a great deal of material with files or abrasives. Furthermore, with a large bearing surface, the force from the strings is distributed over the whole length of the saddle and the whole length of the pickup, rather than being concentrated on the respective crystals where it would generate a signal. This results in a loss of efficiency for the pickup and may result in a lower signal to noise ratio.

Calibration of the saddle is achieved by playing each string independently and comparing the relative volumes of the strings. However, calibration of the saddle is rendered more difficult by the continuous lower edge because if the saddle is binding at a point which does not correspond to a crystal, the results of the calibration may be ambiguous. For example, if the bridge does not contact the crystals at the centre of the pickup, it is not readily apparent from which end of the saddle material should be removed. An irregularity at one end of the saddle may be indistinguishable from an irregularity at the other end or both ends of the saddle such that a saddle might be ruined in attempting to achieve the correct shape. If the arch of the sounding board prevents the bridge from contacting the crystals at the ends of the pickup, it is not readily apparent whether to remove material just from the very centre of the saddle or from a larger region centred with respect to the length of the saddle. Removing too much material may silence some of the central strings. While a conservative, iterative process would eventually succeed it shaping the saddle, it would require the repeated tightening and slackening of the strings to insert and remove the saddle and would also require that the strings be re-tightened to the same string tension each time.

There have been attempts to address some of these problems. U.S. Pat. No. 5,644,094 to Dickson discloses a bridge for an acoustic guitar having a backbone portion supported by a plurality of pedestals such that each pedestal supports one string. The pedestals have relatively large bases to more efficiently transfer vibrational energy to a resonant sounding board and are separated from each other by key-hole-shaped spaces which give the pedestals an hour-glass shape. The pedestals are connected to one another by relatively thin connector portions of the backbone portion which permit each pedestal to move relatively independently of the other pedestals so as to permit independent transfer of string vibrational energy. Dickson also discloses the use of two supports, one at each end of the saddle which also contact the sounding board although not directly supporting strings. The Dickson bridge is directed towards use in an acoustic guitar and does not address the requirements of piezo-electric pickups. For example, the enlarged bases, which are desirable for transmitting vibrational energy to a sounding board in an acoustical guitar would result in only a relatively small part of each base actually resting on a crystal in an electro-acoustical guitar, the rest of each base being unnecessarily disposed over the surface of the pick-up such that irregularities in the surface of the instrument or the pickup might interfere with the proper loading of the crystals. The addition of the two end supports would further aggravate this problem. Furthermore, due to the hour-glass shape of the pedestals, if a large amount of material must be removed from their bases, the shape and cross-sectional areas of the pedestals change. This results in a saddle which is unpredictable and difficult to adjust or calibrate.

A saddle for electro-acoustic guitars which is based on the Dickson device is produced by the Fishman company under the trademark "Cleartone Saddle ". The Cleartone saddle is substantially the same as the Dickson device with the exception that the two supports have been combined with two of the pedestals so that the two endmost pedestals are larger than the remaining pedestals. The Cleartone saddle suffers from the same short comings as the Dickson device with the additional problem that the pedestals do not have equal base areas such that unequal pressures may be applied to respective crystals.

Therefore, what is needed is a saddle for a stringed instrument which focuses the string pressure directly onto the piezo-electric crystals of a piezo-electric pickup and which is easily and consistently adjustable so that equal biasing force is applied to each piezo electric crystal.

SUMMARY OF THE INVENTION

The present invention reduces some of the problems of the prior art by providing a saddle having a plurality of pillars with crystal contacting bases such that the pillars are separated by gaps which are relatively large in comparison to the bases. This results in a pickup contacting area defined by the combined area of the bases which is relatively small compared to the pickup contacting area of a saddle with a continuous base surface and therefore results in a relatively larger biasing pressure defined by string force divided by pickup contacting area. Furthermore, all of the bases have substantially equal surface areas so that each crystal receives substantially the same amount of pressure. Furthermore, each of the pillars has constant cross-sectional areas along its length so that adjusting the height of a pillar does not change the surface area of its base.

In accordance with one aspect of the invention there is provided a saddle for connection to a stringed instrument in which the saddle comprises a longitudinally extending string support portion having an engaging surface to engage strings of the instrument, and a plurality of substantially parallel pillars extending transversely from the support portion and disposed oppositely to the engaging surface. Each of the pillars has a cross-sectional area which is substantially constant along the length of the pillar.

In accordance with another aspect of the invention there is provided a saddle for connection to a stringed instrument in which the saddle comprises a longitudinally extending string support portion having an engaging surface to engage strings of the instrument, and a plurality of substantially parallel pillars extending transversely from the support portion and disposed oppositely to the engaging surface. Each of the pillars has a base surface which is remote from the engaging surface. A sum of the surface areas of the base surfaces defines a total base surface area which is substantially smaller than a surface area of the engaging surface whereby a biasing force applied to the engaging surface is transmitted to the substantially smaller total base surface area.

DETAILED DESCRIPTION

Figure 1:
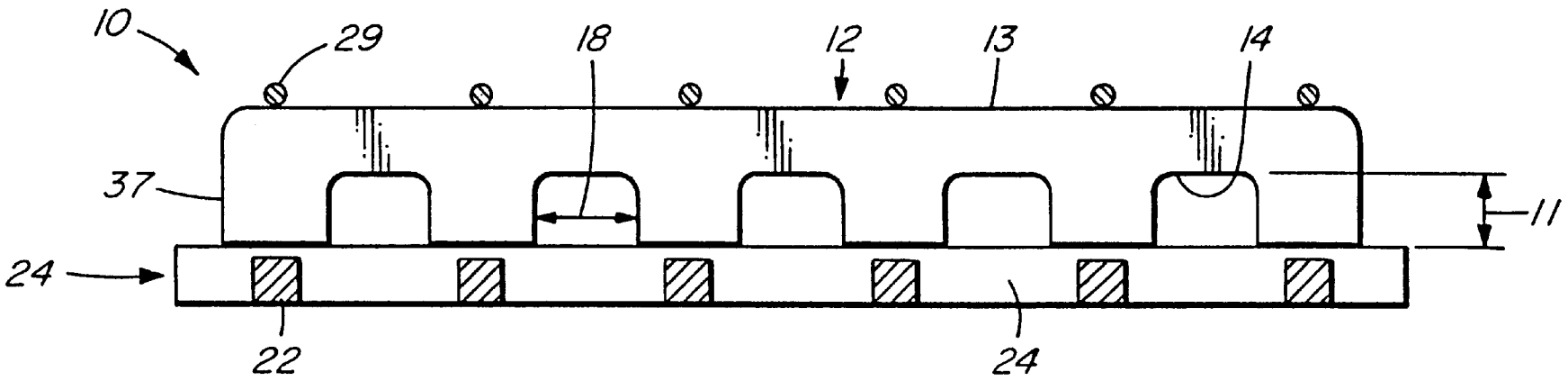
FIG. 1 is a simplified sectional view along a front elevation of a saddle according to a first embodiment of the invention disposed relative to an acoustical pickup and a plurality of strings.
Figure 2:
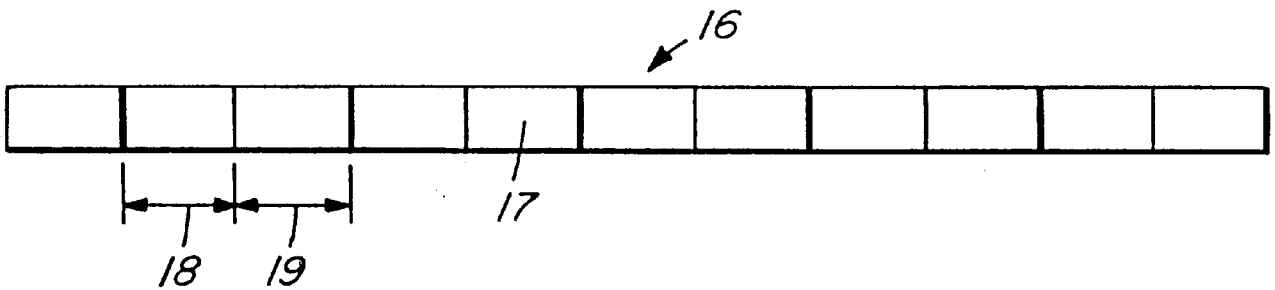
FIG. 2 is a bottom plan view of the saddle of FIG. 1.

Referring to FIGS. 1 and 2, a saddle 10 is shown disposed adjacent to a piezo-electric pickup 24. The saddle 10 comprises a longitudinally extending string support portion 12 having a string engaging surface 13 and a plurality of substantially parallel pillars 14 extending perpendicularly from the string support portion 12 and disposed oppositely to the string engaging surface 13. Each of the pairs 14 has a length 11, a width 19, a plurality of substantially parallel longitudinal vertices, and a substantially flat base 16 having a base area 17. Each of the pillars 14 has constant cross-sectional areas throughout its length 11, equal to the base area 17 and all of the pillars 14 have substantially equal base areas 17. Each pair of adjacent pillars 14 define a gap 18 therebetween such that the width of the gap 18 is relatively large compared to the width 19 of the pillars 14. In a one embodiment, the gap 18 is substantially equal in size to the width 19 of the pillars 14.

Figure 3:
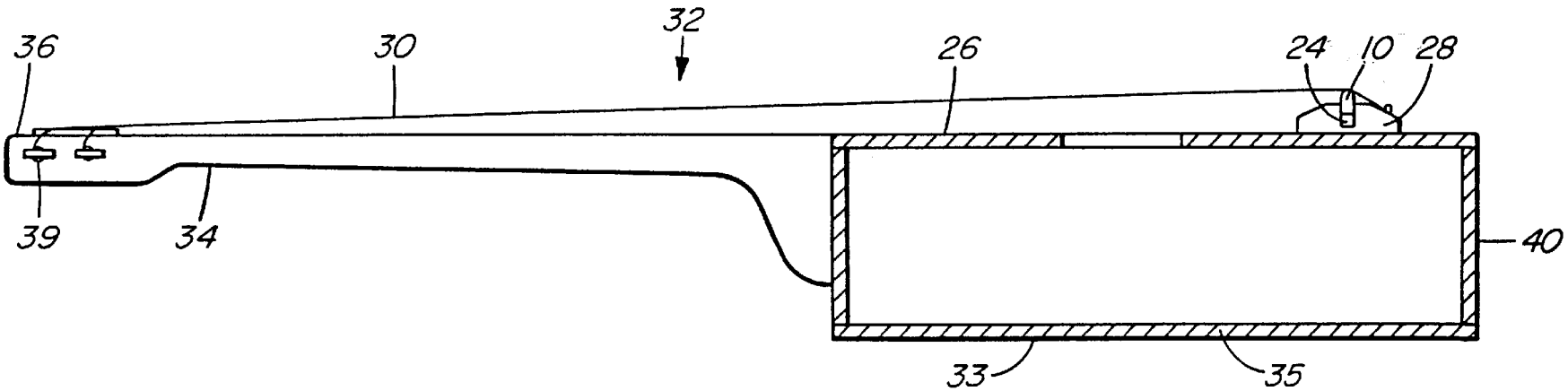
FIG. 3 is a longitudinal sectional view of a stringed instrument including a bridge, an acoustical pickup and a saddle according to a first embodiment of the invention.
Figure 4:
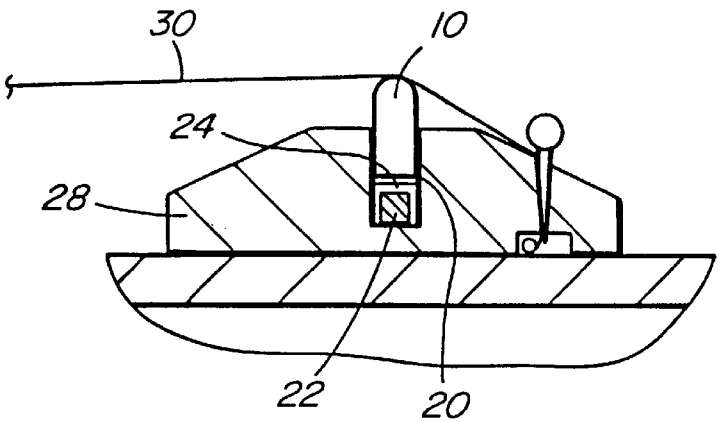
FIG. 4 is a simplified cross-section of the bridge of FIG. 3.

Referring to FIGS. 3 and 4 the saddle 10 is shown connected to an electro-acoustical stringed instrument 32. The instrument 32 comprises a hollow body 33 having a sounding board 26, a back face 35 which is substantially parallel to the sounding board 26, and a connecting portion 40 which connects the sounding board 26 to the back face 35 around a perimeter of the sounding board. A longitudinally extending neck member 34 extends from the body 33 and has a distal end 36 having a plurality of string receiving and tighting members 39. A bridge 28 having a slot 20 therein is connected to the sounding board 26, remote from the neck member 34. A pickup 24 having a plurality of piezo-electric crystals 22 is located in the slot 20 and is electrically connectable to an amplifier (not shown). A plurality of strings 30 extend between the bridge 28 and the string receiving and tightening members 39 such that the strings 30 can be releasably tightened. The saddle 10 is slideably fitted into the slot 20 in the bridge 28 adjacent the pickup 24 and is held in place by the strings 30 such that string tension presses the strings 30 against the saddle 10 and presses the saddle 10 against the pickup 24, thereby compressing the pickup between the saddle and the bridge.

OPERATION

In operation the saddle 10 is inserted into the slot 20 in the bridge 28 and positionally adjusted so that the base 16 of each pillar 14 is substantially centred over and in close contact with a piezo-electric crystal 22 of the pickup 24. The saddle 10 is slideably held in the slot 20 by friction. The plurality of strings 30 are tightened so as to exert a biasing force upon the saddle 10, directed toward the sounding board 26, thereby compressing the pickup between the saddle and the bridge. The pickup 24 is electrically connected to the amplifier and each of the strings 30 is played individually and the volume of sound from the amplifier is noted. If the volume of sound corresponding to a first string 29 is less than that from each of the other strings, then the piezo-electric crystal 22 under the first string 29 is too heavily loaded in comparison to the other crystals and a first pillar 37 corresponding to the first string 29 is shortened by removing the saddle 10 from the bridge 28 and removing material from the base 16 of the first pillar 37 by sanding, filing, etc. If the volume of sound from the first string 29 is greater than the volume of sound from the each of the other strings, or if there is no appreciable sound at all, then the crystal corresponding to the first string 29 is loaded too lightly and all of the other pillars 14 are shortened. The process is repeated and the height of each pillar 14 is adjusted until the volume of sound from all of the strings is substantially equal.

Because each pillar 14 is associated with only one string 30 and only one crystal 22, string volume imbalances can be traced immediately to the specific pillar 14 which is causing the imbalance. The pillars 14 have a substantially reduced pickup contacting area or base area 17 because of the relatively large gaps 18 between pillars 14. The substantially reduced pickup contacting area requires the removal of substantially less material to adjust the saddle than a conventional saddle and the saddle is less affected by the arch of the instrument as the saddle 10 only contacts the pickup 24 at six well-defined points. The reduced contacting area results in more of the string force being applied to the piezo-electric crystals and less being applied unnecessarily to the remaining surface of the pickup. The substantially identical base areas of the pillars minimizes initial string imbalances such that only fine-tuning of the saddle should be required. Finally, because the crosssectional area of a pillar 14 does not change as its length 11 is adjusted, adjustments to the saddle are repeatable and predictable.

While specific embodiments of the invention have been described and illustrated, such embodiments should be considered illustrative of the invention only and not as limiting the invention as construed in accordance with the accompanying claims.

What is claimed is:

1. A saddle for connection to a stringed instrument via a slot formed in the bridge of the instrument having an acoustical pickup at the base of the slot formed from a plurality of piezo electric crystals, the saddle comprising:

a) a longitudinally extending string support portion having an engaging surface to engage strings of the instrument; and b) a plurality of substantially parallel pillars extending perpendicularly from the support portion and disposed oppositely to the engaging surface, each of the pillars having a length and a cross-sectional area which is substantially constant along the length of the pillar, each of the pillars being dimensioned for slidable frictional engagement within the slot and each of the pillars being spaced from adjacent pillars to be positioned over one of the plurality of piezo-electric crystals of the acoustical pickup to maximize contact therewith and minimize contact with the rest of the pickup.

2. A saddle as claimed in claim 1 in which each of the pillars has a base surface which is remote from the engaging surface wherein the cross-sectional area of each of the pillars is equal to a surface area of the base surface.

3. A saddle as claimed in claim 2 in which all of the base surfaces have substantially equal areas whereby a biasing force applied to the engaging surface results in substantially equal pressures exerted on each of the base surfaces.

4. A saddle as claimed in claim 2 in which a sum of the surface areas of the base surfaces defines a total base surface area which is substantially smaller than a surface area of the engaging surface whereby a biasing force applied to the engaging surface is transmitted to the substantially smaller total base surface area, resulting in a proportionately higher base pressure.

5. A saddle as claimed in claim 4 in which the total base surface area is approximately half of the surface area of the engaging surface.

6. A saddle for connection to a stringed instrument via a slot formed in the bridge of the instrument having an acoustical pickup at the base of the slot formed from a plurality of piezo electric crystals, the saddle comprising:

a) a longitudinally extending string support portion having an engaging surface to engage strings of the instrument; and b) a plurality of substantially parallel pillars extending transversely from the support portion and disposed oppositely to the engaging surface, each of the pillars being dimensioned for slidable frictional engagement within the slot and each of the pillars being spaced from adjacent pillars to be positioned over one of the plurality of piezo-electric crystals of the acoustical pickup to maximize contact therewith and minimize contact with the rest of the pickup, each of the pillars having a base surface defining a base area which is remote from the engaging surface, in which a sum of the base areas defines a total base area which is substantially smaller than a surface area of the engaging surface whereby a biasing force applied to the engaging surface is transmitted to the substantially smaller total base area.

7. A saddle as claimed in claim 6 in which the total base area is approximately half of the surface area of the engaging surface.

8. A saddle as claimed in claim 6 in which each of the pillars has a length and a cross-sectional area which is substantially constant along the length of the pillar, the cross-sectional area being equal to the base area.

9. A saddle as claimed in claim 6 in which all of the base surfaces have substantially equal areas whereby a biasing force applied to the engaging surface results in substantially equal pressures exerted on each of the base surfaces.

* * * * *